US008967291B2

(12) United States Patent
Bonavides et al.

(10) Patent No.: US 8,967,291 B2
(45) Date of Patent: Mar. 3, 2015

(54) PRESSURE-ACTIVATED SWITCH

(75) Inventors: Clovis Satyro Bonavides, Houston, TX (US); Donald Leon Crawford, Spring, TX (US); Paul Anthony Molina, Houston, TX (US); Gabriel Vicencio Mata, Pasadena, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 352 days.

(21) Appl. No.: 13/494,075

(22) Filed: Jun. 12, 2012

(65) Prior Publication Data

US 2013/0327514 A1 Dec. 12, 2013

(51) Int. Cl.
*E21B 43/1185* (2006.01)

(52) U.S. Cl.
USPC ..... 175/4.56; 102/263

(58) Field of Classification Search
CPC ..... F42C 15/32; F42C 15/40; H01H 35/38
USPC ..... 102/263, 206, 262, 223, 310, 427–429; 200/82 R; 175/4.56; 361/247–251; 89/1.15
See application file for complete search history.

(56) References Cited

U.S. PATENT DOCUMENTS

| | | | | |
|---|---|---|---|---|
| 3,002,063 | A | 9/1961 | Giladett | |
| 3,612,793 | A | 10/1971 | Roeser | |
| 4,544,034 | A * | 10/1985 | George | 166/297 |
| 4,727,810 | A * | 3/1988 | Furst et al. | 102/263 |
| 5,908,365 | A | 6/1999 | Lajaunie et al. | |
| 7,915,550 | B2 * | 3/2011 | Beaulieu | 200/275 |
| 2008/0110612 | A1 | 5/2008 | Prinz et al. | |
| 2009/0050322 | A1 | 2/2009 | Hill et al. | |
| 2011/0271823 | A1 | 11/2011 | Vicente | |

OTHER PUBLICATIONS

International Searching Authority, International Search Report and Written Opinion of the International Searching Authority in PCT/US2013/043304, which is a PCT counterpart to the instant application, Oct. 22, 2013.

Australian Government P Australia, Notice of Acceptance, Application No: 2013274760, which is the counterpart AU application to the instant application, Dec. 8, 2014.

Australian Government IP Australia, Patent Examination Report No. 1, Patent Application No: 2013274760, which is the counterpart AU application to the instant application, Nov. 10, 2014.

International Preliminary Report on Patentability, Application No: PCT/US2013/043304, Dec. 16, 2014, which is the child PCT application of the instant application.

* cited by examiner

*Primary Examiner* — Shane Bomar
*Assistant Examiner* — Kipp Wallace
(74) *Attorney, Agent, or Firm* — Howard L. Speight

(57) ABSTRACT

A first end of a conductive spring is embedded in a wall of a large chamber of a piston housing. The spring is held in tension by a second end of the spring being pinned against a bead contact by a trigger pin. The diameter of the piston and a tensile breaking strength of the trigger pin are selected so that the trigger pin is breakable and the tension in the spring is releasable upon the presence of a predetermined pressure difference between a pressure on the contact side of the piston and a pressure on the pinning side of the piston. Release of tension in the spring closes an electrical circuit.

7 Claims, 12 Drawing Sheets

PRESSURE-ACTIVATED SWITCH

BACKGROUND

An oil well typically goes through a "completion" process after it is drilled. Casing is installed in the well bore and cement is poured around the casing. This process stabilizes the well bore and keeps it from collapsing. Part of the completion process involves perforating the casing and cement so that fluids in the formations can flow through the cement and casing and be brought to the surface. The perforation process is often accomplished with shaped explosive charges. These perforation charges are often fired by applying electrical power to an initiator. Applying the power to the initiator in the downhole environment is a challenge.

DETAILED DESCRIPTION

Figure 1:
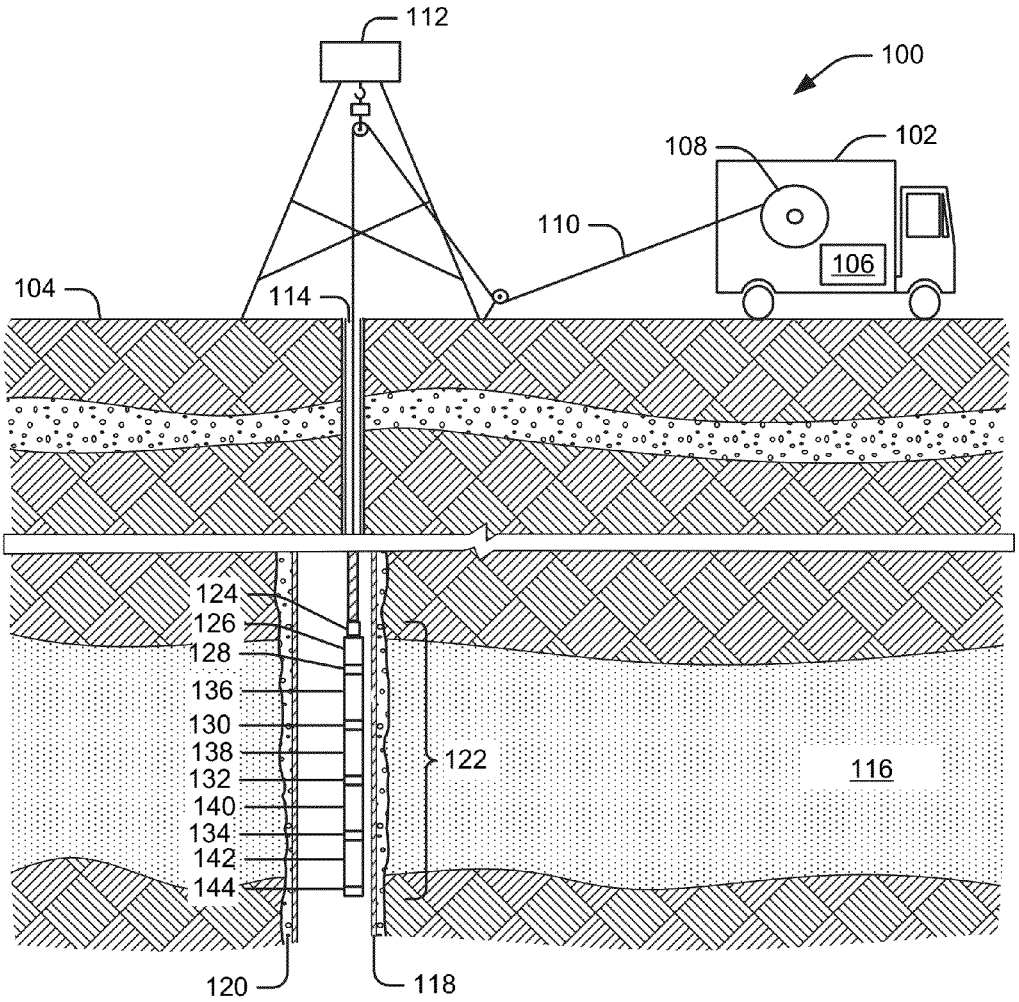
FIG. 1 illustrates a perforation system.

In one embodiment of a perforation system 100 at a drilling site, as depicted in FIG. 1, a logging truck or skid 102 on the earth's surface 104 houses a shooting panel 106 and a winch 108 from which a cable 110 extends through a derrick 112 into a well bore 114 drilled into a hydrocarbon-producing formation 116. In one embodiment, the derrick 112 is replaced by a truck with a crane (not shown). The well bore 114 is lined with casing 118 and cement 120. The cable 110 suspends a perforation apparatus 122 within the well bore 114.

Figure 2:
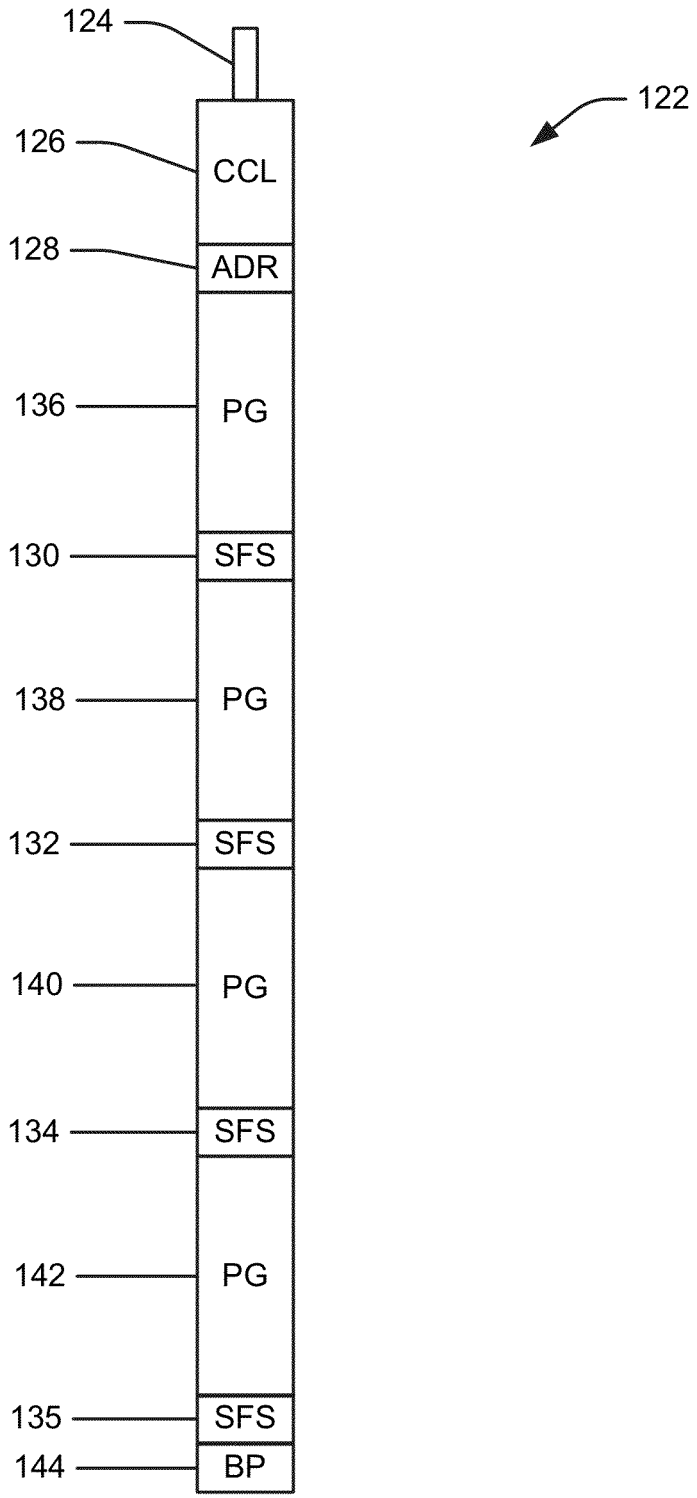
FIG. 2 illustrates a perforation apparatus.

In one embodiment shown in FIGS. 1 and 2, the perforation apparatus 122 includes a cable head/rope socket 124 to which the cable 110 is coupled. In one embodiment, an apparatus to facilitate fishing the perforation apparatus (not shown) is included above the cable head/rope socket 124. In one embodiment, the perforation apparatus 122 includes a casing collar locator ("CCL") 126, which facilitates the use of magnetic fields to locate the thicker metal in the casing collars (not shown). The information collected by the CCL can be used to locate the perforation apparatus 122 in the well bore 114. A gamma-perforator (not shown), which includes a CCL, may be included as a depth correlation device in the perforation apparatus 122.

In one embodiment, the perforation apparatus 122 includes an adapter ("ADR") 128 that provides an electrical and control interface between the shooting panel 106 on the surface and the rest of the equipment in the perforation apparatus 122.

In one embodiment, the perforation apparatus 122 includes a plurality of select fire subs ("SFS") 130, 132, 134, 135 and a plurality of perforation charge elements (or perforating gun or "PG") 136, 138, 140, and 142. In one embodiment, the number of select fire subs is one less than the number of perforation charge elements.

Figure 4:
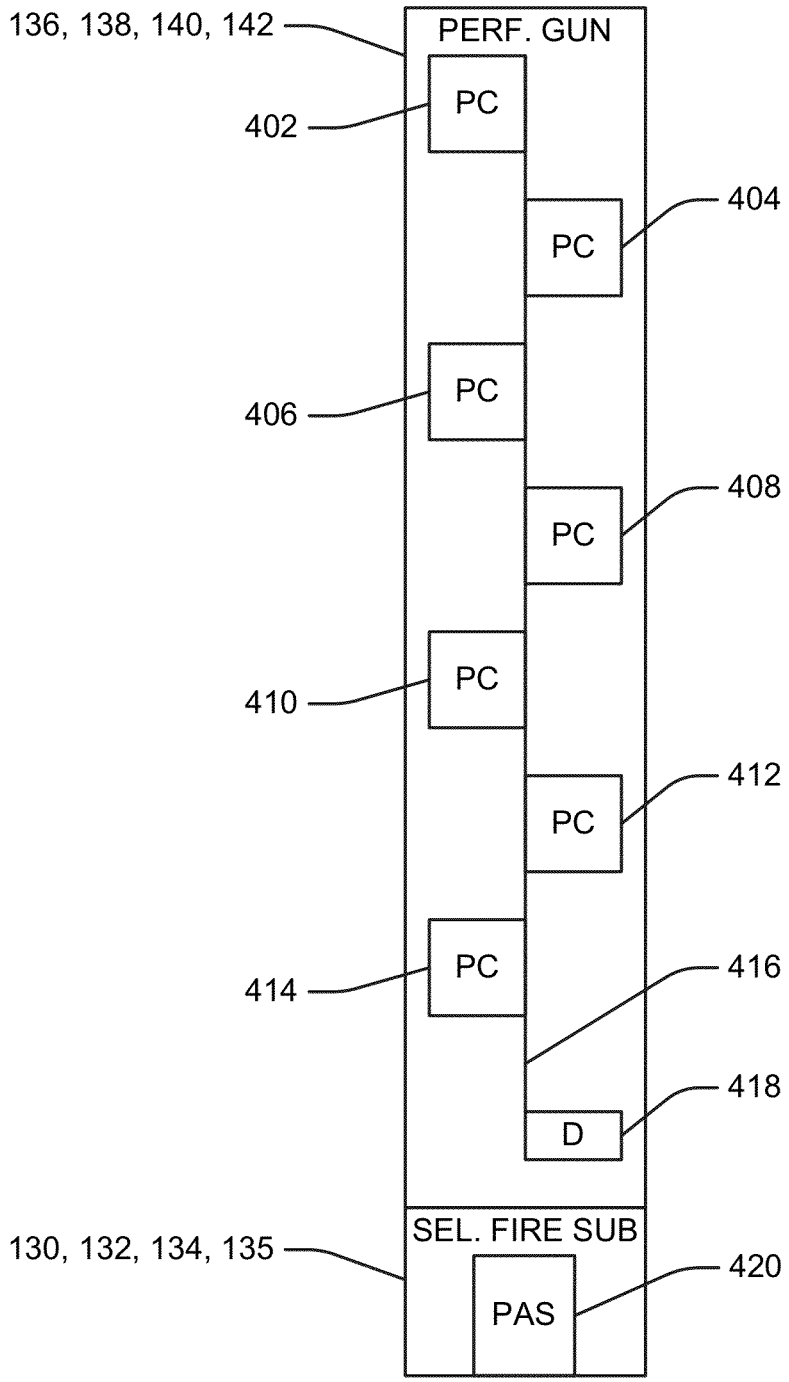
FIG. 4 is a block diagram of a perforation apparatus.

The perforation charge elements 136, 138, 140, and 142 are described in more detail in the discussion of FIG. 4. It will be understood by persons of ordinary skill in the art that the number of select fire subs and perforation charge elements shown in FIGS. 1 and 2 is merely illustrative and is not a limitation. Any number of select fire subs and sets of perforation charge elements can be included in the perforation apparatus 122.

In one embodiment, the perforation apparatus 122 includes a bull plug ("BP") 144 that facilitates the downward motion of the perforation apparatus 122 in the well bore 114 and provides a pressure barrier for protection of internal components of the perforation apparatus 122. In one embodiment, the perforation apparatus 122 includes magnetic decentralizers (not shown) that are magnetically drawn to the casing causing the perforation apparatus 122 to draw close to the casing as shown in FIG. 1. In one embodiment, a setting tool (not shown) is included to deploy and set a bridge or frac plug in the borehole.

Figure 3:
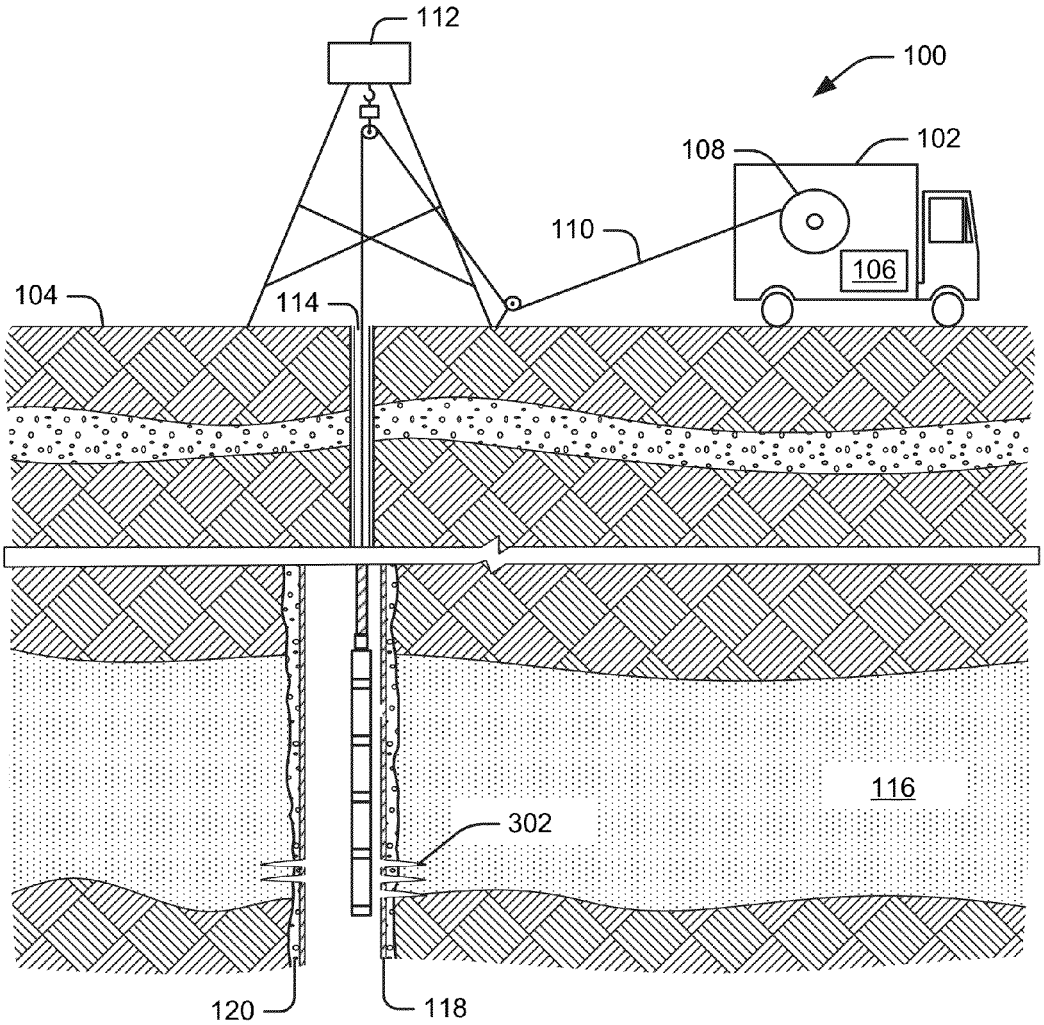
FIG. 3 illustrates the perforation system after one of the perforation charges has been fired.

FIG. 3 shows the result of the explosion of the lowest perforation charge element. Passages 302 (only one is labeled) have been created from the formation 116 through the concrete 120 and the casing 118. As a result, fluids can flow out of the formation 116 to the surface 104. Further, stimulation fluids may be pumped out of the casing 118 and into the formation 116 to serve various purposes in producing fluids from the formation 116.

One embodiment of a perforation charge element 136, 138, 140, 142, illustrated in FIG. 4, includes 7 perforating charges (or "PC") 402, 404, 406, 408, 410, 412, and 414. It will be understood that by a person of ordinary skill in the art that each perforation charge element 136, 138, 140, 142 can include any number of perforating charges.

In one embodiment, the perforating charges are linked together by a detonating cord 416 which is attached to a detonator 418. In one embodiment, when the detonator 418 is detonated, the detonating cord 416 links the explosive event to all the perforating charges 402, 404, 406, 408, 410, 412, 414, detonating them simultaneously. In one embodiment, a select fire sub 130, 132, 134, 135 containing a single pressure activated switch ("PAS") 420 is attached to the lower portion of the perforating charge element 136, 138, 140, 142. In one embodiment, the select fire sub 130, 132, 134, 135 defines the polarity of the voltage required to detonate the detonator in the perforating charge element above the select fire sub. Thus in one embodiment, referring to FIG. 2, select fire sub 130 defines the polarity of perforating charge element 136, select fire sub 132 defines the polarity of perforating charge element 138, select fire sub 134 defines the polarity of perforating charge element 140, and select fire sub 135 defines the polarity of perforating charge element 142. In one embodiment not shown in FIG. 2, the bottom-most perforating charge element 142 is not coupled to a select fire sub (i.e., select fire sub 135 is not present) and thus can be detonated by a voltage of either polarity.

Figure 8:
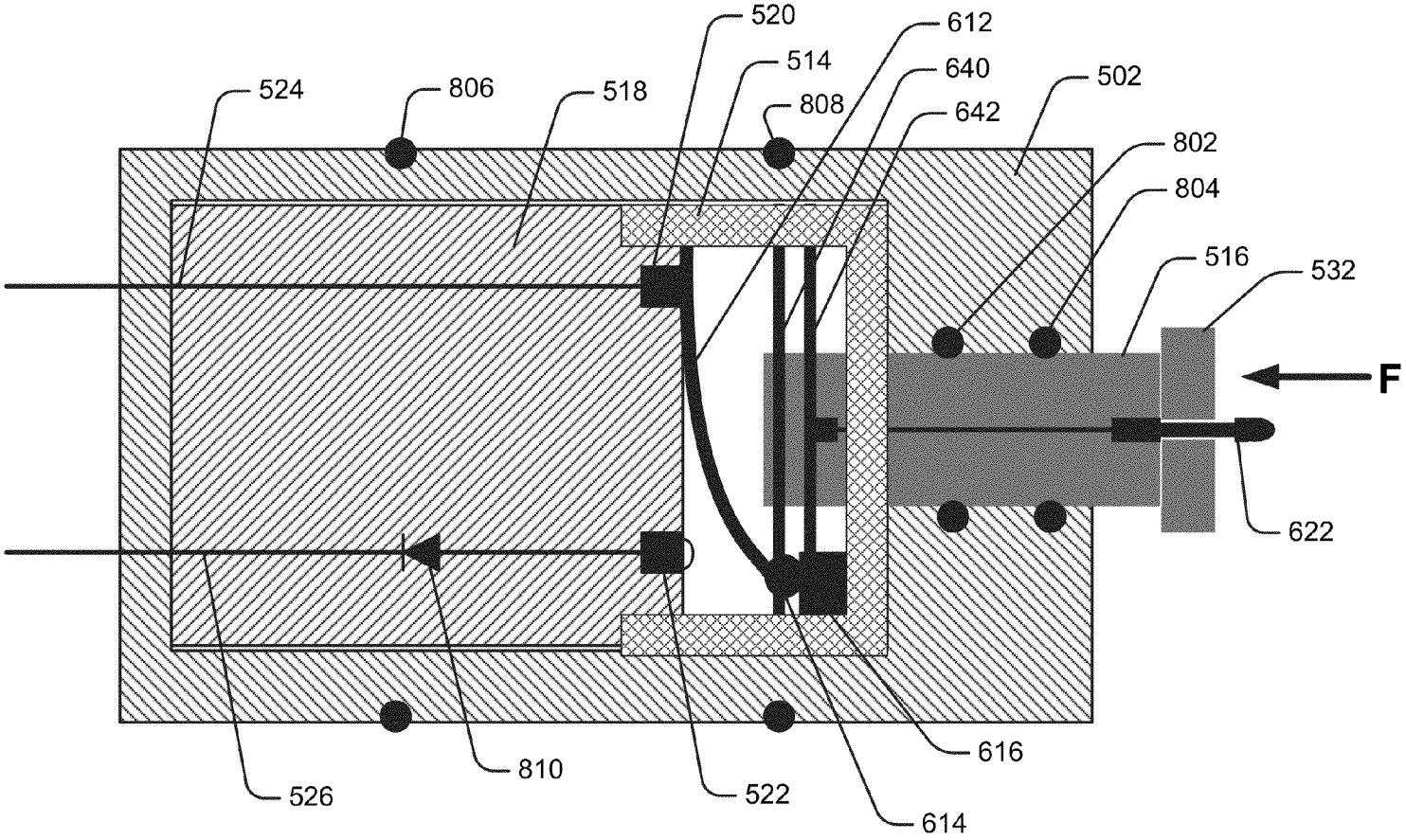
FIG. 8 is a cross-sectional view of a pressure activated switch before it is actuated.
Figure 9:
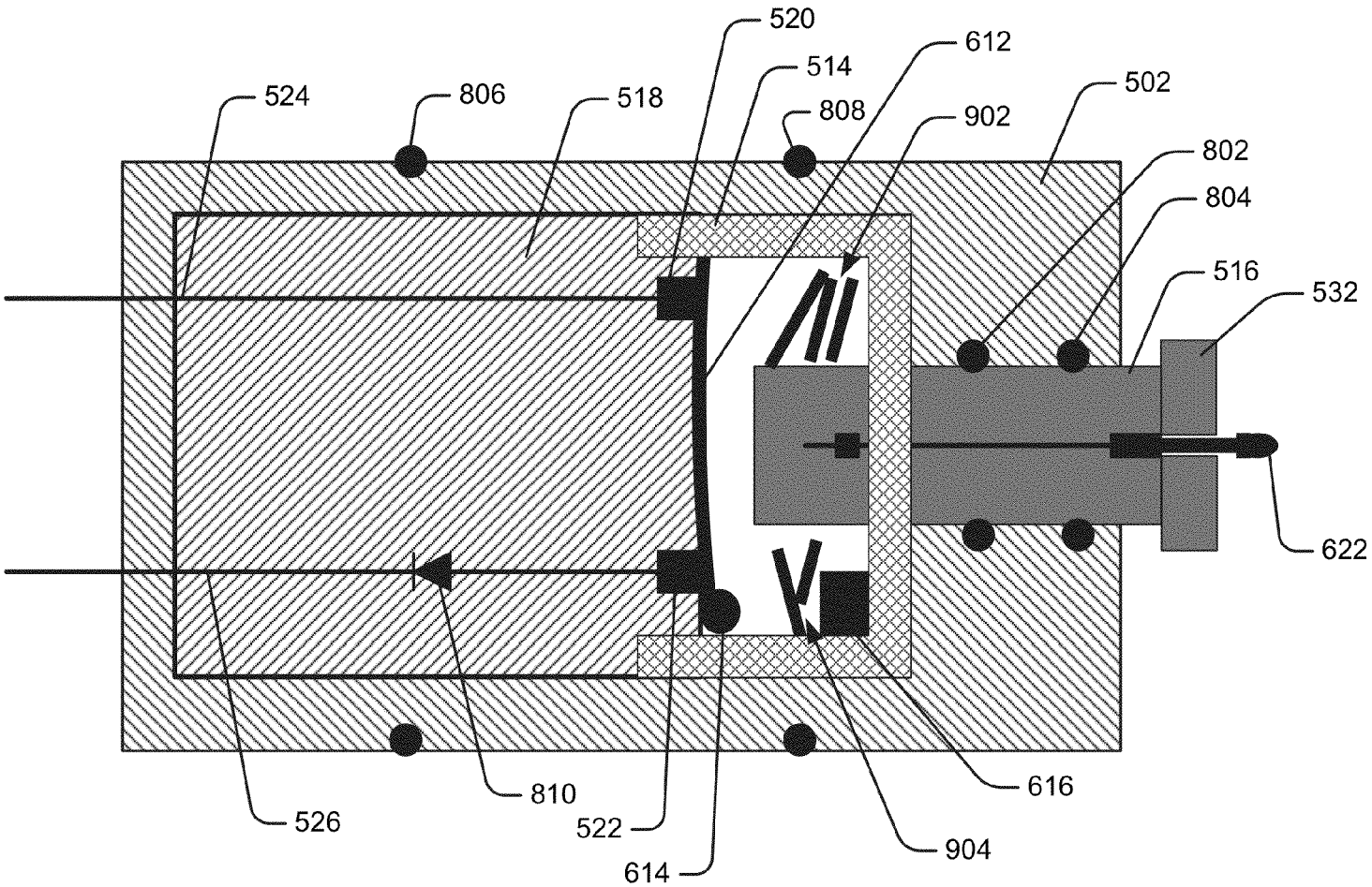
FIG. 9 is a cross-sectional view of a pressure activated switch after it is actuated.

One embodiment of a pressure activated switch 420, shown in FIGS. 5-9, includes a housing 502 that fits within a housing, not shown, for a select fire sub 130, 132, 134, 135. In one embodiment, O-rings 806 and 808, not shown in FIG. 5, 6, or 7 but shown in FIGS. 8 and 9, provide a seal between the housing 502 and the housing for the select fire sub 130, 132, 134, 135. In one embodiment, the housing 502 has a large opening 504 at one end and a small opening 506 at the other end. In one embodiment, a large chamber 508 extends from the large opening 504 to a shoulder 510. In one embodiment, a small chamber 512 extends from the shoulder 510 to the small opening 506.

In one embodiment, a piston housing 514 houses a piston 516. In one embodiment, the piston housing 514 is cylindrical. In other embodiments (not shown), the piston housing 514 has other shapes, in which the cross-section of the piston housing 514 is square, rectangular, oval, or some other shape. In one embodiment, the piston housing 514 has an outside diameter that fits within the inside diameter of the large chamber 508. In one embodiment, the piston 516 is cylindrical. In other embodiments (not shown), the piston 516 has other shapes, in which the cross-section of the piston 516 is square, rectangular, oval, or some other shape. In one embodiment, the piston 516 has an outside diameter that is substantially the same (i.e., with enough of a difference to allow for the insertion of O-rings 802 and 804, not shown in FIG. 5, 6, or 7 but shown in FIGS. 8 and 9) as the small piston-receiving chamber 610 (described below). In one embodiment, the piston housing 514 and the piston 516 are made of polyether ether ketone (or "PEEK"). In one embodiment, the piston includes O-rings 802 and 804, not shown in FIG. 5, 6, or 7 but shown in FIGS. 8 and 9, that provide a seal between the piston 516 and the piston housing 514.

Figure 6:
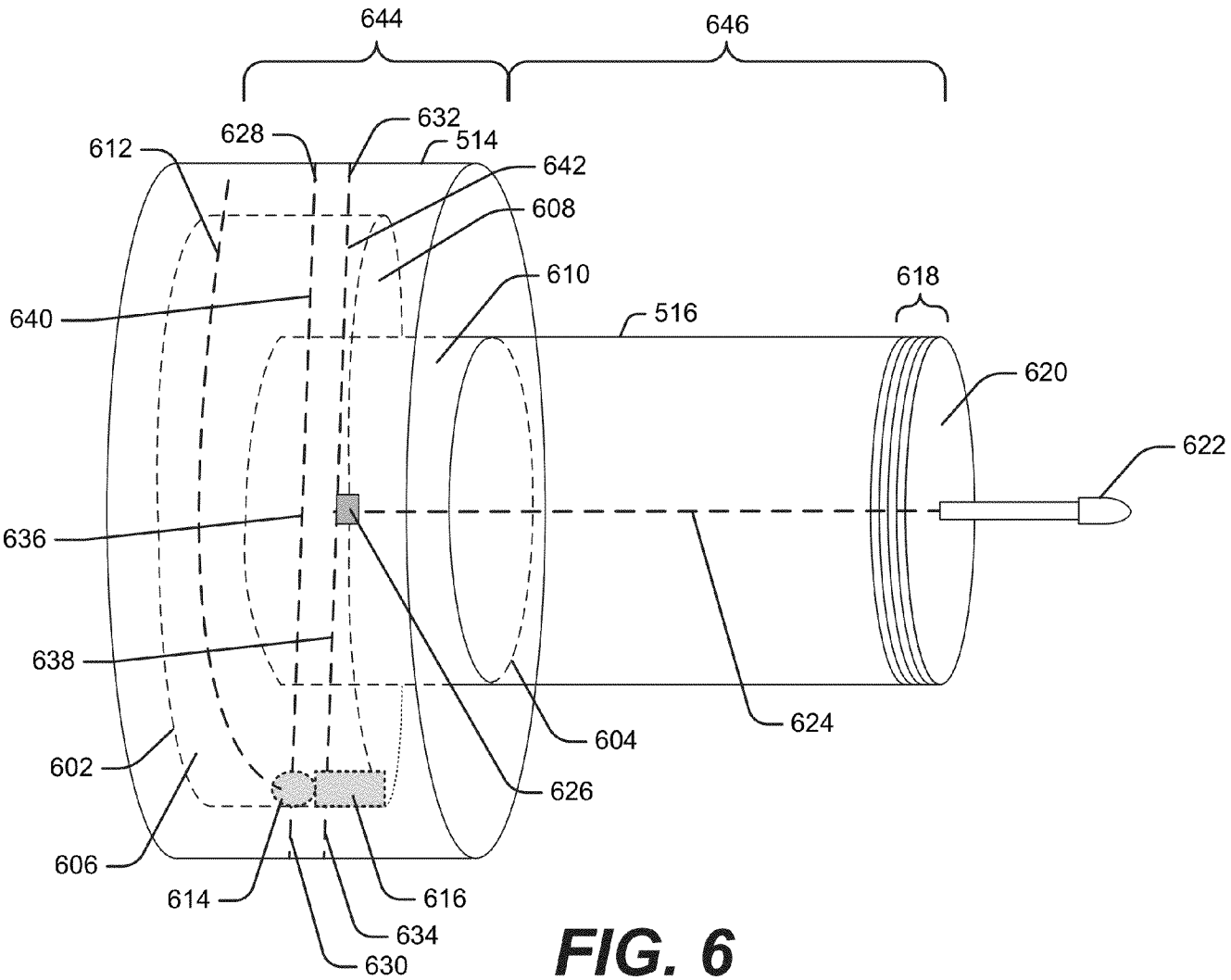
FIG. 6 is a perspective view of elements of a pressure activated switch.

The piston housing 514, shown in more detail in FIG. 6, has a large contact-housing-receiving opening 602 and a small piston-receiving opening 604. A large contact-housing-receiving chamber 606 extends from the large contact-housing-receiving opening 602 to a piston-housing shoulder 608. A small piston-receiving chamber 610 extends from the piston-housing shoulder 608 to the small piston-receiving opening 604.

In one embodiment, the piston housing 514 and the piston 516 are made of a non-conductive material. In one embodiment, the piston housing 514 and the piston 516 are made of PEEK.

In one embodiment, an electrically conductive leaf spring 612 is embedded in the piston housing 514 at one end and has a securing bead 614 at the other end. In one embodiment, the spring 612 is made of an electrically conductive spring material, such as copper or bronze. In one embodiment, the spring 612 is a wire. In one embodiment, the spring 612 has a ribbon shape.

In one embodiment, the securing bead 614 is a ball of conductive material, such as copper or bronze, welded or soldered to the end of the spring 612. In one embodiment, the securing bead 614 is formed from the spring 612 by, for example, flattening the end of a wire. In one embodiment, a hole is drilled or otherwise formed in the securing bead 614 to receive a pin as described below.

In one embodiment, a conductive bead contact 616 is coupled, e.g., using an adhesive, to a wall of the large contact-housing-receiving chamber 606. In one embodiment, a hole is drilled or otherwise formed in the bead contact 616 to receive a pin as described below.

In one embodiment, the piston 516 has threads 618 at its threaded end 620. In one embodiment, the threads 618 receive the stop 532 (not shown in FIG. 6). In one embodiment, a tip contact 622 extends from the threaded end 620 of the piston 516. In one embodiment, a conductor 624, such as a wire, extends from the tip contact 622 to a pin contact 626. In one embodiment, the piston housing 614 has holes 628, 630, 632, and 634 drilled through from the outer circumference of the piston housing 614 to the large contact-housing-receiving chamber 606. In one embodiment, hole 628 is substantially (i.e., within 10 degrees) collinear with hole 630 and hole 632 is substantially (i.e., within 10 degrees) collinear with hole 634. In one embodiment, piston 516 includes holes 636 and 638 that are substantially (i.e., within 10 degrees) perpendicular to a longitudinal axis of the piston 516 and are spaced apart by substantially (i.e., within 1 millimeter) the same amount as holes 628 and 632 and holes 630 and 634. In one embodiment, the piston 516 can be rotated so that hole 636 is substantially (i.e., within 10 degrees) collinear with holes 628 and 630 and hole 638 is substantially (i.e., within 10 degrees) collinear with holes 632 and 634.

In one embodiment, the hole in bead contact 616 is alignable with hole 634.

In one embodiment, a trigger pin 640 (represented by a hidden line) passes through hole 628 (which is not distinguished in FIG. 6 from the hidden line representing the trigger pin 640), a portion of the large contact-housing-receiving chamber 606 above (as seen in FIG. 6) the piston 516, hole 636 (which is not distinguished in FIG. 6 from the hidden line representing the trigger pin 640), a portion of the large contact-housing-receiving chamber 606 below (as seen in FIG. 6) the piston 516, the securing bead 614 and hole 630 (which is not distinguished in FIG. 6 from the hidden line representing the trigger pin 640). In one embodiment, the spring 612 is deflected from a position in which it is relaxed into the position shown in FIG. 6, in which the spring 612 is in tension and is urging the securing bead 614 toward the large contact-housing-receiving opening 602. In one embodiment, the securing bead 614, which is held in position by the trigger pin 640, keeps the spring 612 in tension.

In one embodiment, when the spring bead 614 is in the position shown in FIG. 6 it is in electrical contact with the bead contact 616. In one embodiment (not shown), the bead contact 616 includes a geometrically-shaped object (i.e., a cube, sphere, cone, ovoid, cylinder, parallelpiped, etc., or variations on those shapes) that is projected from the surface of the bead contact 616 by a captive spring imbedded in the surface of the bead contact 616 and can be pressed into the surface of the bead contact 616 by the spring bead 614 while maintaining contact with the spring bead 614. In one embodiment, the captive spring is conductive and provides an electrical connection to the spring bead 614 and the spring 612.

In one embodiment, a conductive pin 642 (represented by a hidden line) passes through hole 632 (which is not distinguished in FIG. 6 from the hidden line representing the conductive pin 642), a portion of the large contact-housing-receiving chamber 606 above (as seen in FIG. 6) the piston 516, hole 638 (which is not distinguished in FIG. 6 from the hidden line representing the conductive pin 642), a portion of the large contact-housing-receiving chamber 606 below (as seen in FIG. 6) the piston 516, the hole in the bead contact 616 and hole 634 (which is not distinguished in FIG. 6 from the hidden line representing the conductive pin 642). In one embodiment, as conductive pin 642 passes through hole 638 it makes electrical contact with pin contact 626 and with bead contact 616. Thus, in the configuration shown in FIG. 6, tip contact 622 is electrically coupled to spring 612 through a pin conductor 624, pin 642, bead contact 616, and securing bead 614.

In one embodiment, the piston 516 has a pinning portion 644 that is the portion of the piston that extends into the large contact-housing-receiving chamber 606 and is pierced by the trigger pin 640 and the conductive pin 642 and a contact portion 646 that includes the portion of the piston that extends outside the piston housing 514, including the threaded end 622 of the piston 516. In one embodiment, the pinning portion 644 and the contact portion 646 are adjacent to each other. In one embodiment, there is a portion of the piston 516 between the pinning portion 644 and the contact portion 646.

Figure 5:
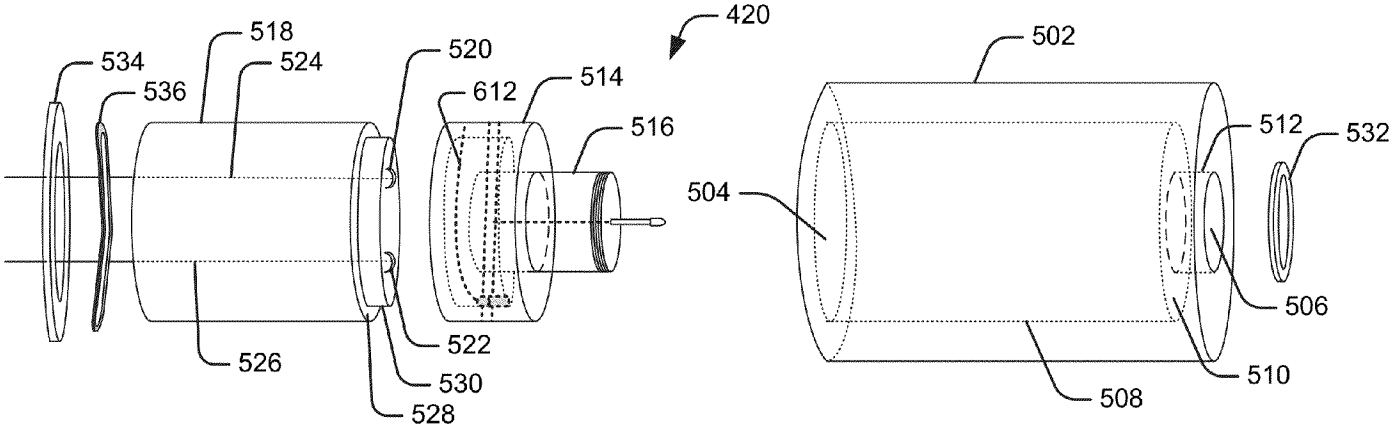
FIG. 5 is an exploded view of a pressure activated switch.
Figure 7:
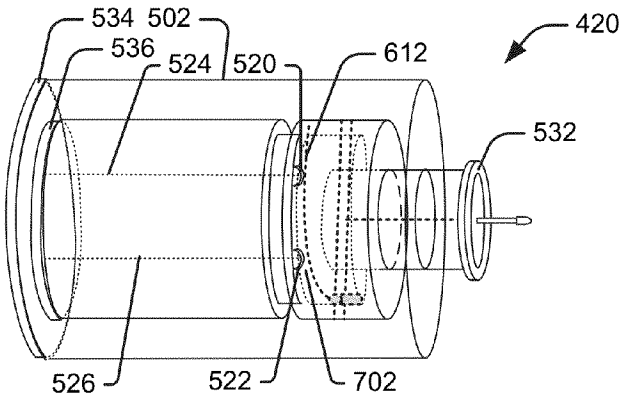
FIG. 7 is a perspective view of a pressure activated switch.

Returning to FIG. 5, in one embodiment, a contact housing 518 includes a first contact 520 and a second contact 522. In one embodiment, the first contact 520 and second contact 522 are half-circles or half-ovals of spring material as shown in FIG. 5. In one embodiment (not shown), the first contact 520 and the second contact 522 are geometrically-shaped objects (i.e., cubes, spheres, cones, ovoids, cylinders, parallelpipeds, etc., or variations on those shapes) that are projected from the surface of the contact housing 518 by captive springs imbedded in the surface of the contact housing 518 and can be pressed into the surface of the contact housing 518 while maintaining contact with the item exerting the pressure. In one embodiment, the captive springs are conductive and provide an electrical connection to the first contact 520 and the second contact 522.

In one embodiment, a first contact conductor 524, such as a wire, provides an electrical path from the first contact 520 to the rear of the pressure activated switch 420. In one embodiment, a second contact conductor 526, such as a wire, provides an electrical path from the second contact 522 to the rear of the pressure activated switch 420. In one embodiment, the contact housing 518 is cylindrical and has an outside diameter that fits within the piston housing 514. In one embodiment, a contact housing shoulder 528 and contact housing shelf 530 are sized so that the contact housing shelf 530 fits within the large contract-housing-receiving chamber 606 and the contact housing 518 can be inserted into the piston housing 514 far enough so that the first contact 520 makes contact with the spring 612 but the second contact 522 does not make contact with the spring 612. This can be seen in FIG. 7, which shows an embodiment of an assembled version of the pressure activated switch 420. In one embodiment, the first contact 520 is in contact with spring 612 but there is a gap 702 between second contact 522 and spring 612. In the configuration shown in FIG. 7, there is an electrical connection between conductor 524 and spring 612 through first contact 520 but no electrical connection between spring 612 and second contact 522.

In one embodiment, the contact housing 518 is made of a non-conductive material. In one embodiment, the contact housing 518 is made of PEEK.

Returning to FIG. 5, a threaded stop 532 attaches to the threaded end 620 of the piston 516 via threads 618 (see also FIG. 6). In one embodiment, a cap 534, which in some embodiments is threaded, and a wave washer 536 hold the contact housing 518 in place inside the housing 502.

In one embodiment, the assembly of the pressure activated switch begins by assembling the piston 515, pins 640 and 642, and spring 612 as shown in FIG. 6. In one embodiment, this assembly is inserted into the housing 502, with the tip contact 622 and the threaded end 620 of the piston 516 passing through the small opening 506 in the housing 502. The stop 532 is then screwed on to the threaded end 620 of the piston 516 where it acts to prevent the piston 516 from moving into the piston housing 514 beyond the point where the stop 532 engages the piston housing 514. In one embodiment, the cap 534 and wave washer 536 secure the contact housing 518 within the housing 502.

As can be seen in the cross-sectional view of one embodiment of the pressure activated switch 420 in FIG. 8, while the piston 516 is not restricted in movement by the piston housing 514 (except for the action of the O-rings 802 and 804 which provide a seal between the piston 516 and the housing 502), the trigger pin 640 and conductive pin 642 restrict the movement of the piston 516 within the piston housing 514 and the housing 502. If, in one embodiment, enough force ("F" in FIG. 8) is exerted on the piston 516, the trigger pin 640 and the conductive pin 641 will break. This is shown in FIG. 9, which shows that the piston 516 has moved into the piston housing 514 and has broken the trigger pin 640 and the conductive pin 641 (represented by broken pieces 902 and 904). In one embodiment, this will free the securing bead 614 and allow the spring 612 to relax into the state shown in FIG. 9 in which the spring 612 completes an electrical circuit between conductor 524 and conductor 526. In one embodiment, increases in the force F caused by the elevated temperatures at depth in an oil well are offset by increased pressure in the large contact-housing-receiving chamber 606 caused by the elevated temperatures.

In one embodiment, the pressure activated switch 420 shown in FIGS. 5-9 is "actuated," as that word is used in this application, when the transition from the state of the pressure activated switch 420 shown in FIG. 8 (the "first state") to the state of the pressure activated switch shown in FIG. 9 (the "second state"). In the first state, there is no electrical connection between first contact conductor 524 and second contact conductor 526. In the second state, there is an electrical connection between first contact conductor 524 and second contact conductor 526. In the first state, there is an electrical connection between the first contact conductor 524 and the tip contact 622. In the second state, there is no electrical connection between the first contact conductor 524 and the tip contact 622.

In one embodiment, O-rings 806 and 808 provide a seal between the housing 502 and a select fire sub housing (not shown). In one embodiment, a diode 810 determines the polarity of current that can flow through the circuit formed by conductor 524, first contact 520, spring 612, second contact 522, and conductor 526. In one embodiment, with the diode 810 arranged as shown in FIGS. 8 and 9, current can flow in conductor 524 and out conductor 526. In an embodiment that is not shown in which the polarity of the diode 810 is reversed, current can flow in conductor 526 and out conductor 524.

In one embodiment, the diode 810 is inside or attached to the contact housing 518. In one embodiment, the diode 810 is outside the contact housing 518 and is attached to the select fire sub 420 in another way.

In one embodiment, the amount of force F required to break the trigger pin 640 and the conductive pin 642 is determined by the following equation:

$$F=A\times P=T$$

where:

A is the cross-sectional area of the piston 516,

P is the pressure exerted on the piston in the direction of Force F in FIG. 8 ($P_{out}$) minus the pressure inside the piston housing 514 ($P_{in}$), i.e., $P=P_{out}-P_{in}$, and T is the combined tensile breaking strength of the trigger pin 640 and the conductive pin 642, where tensile breaking strength is the stress required to cause a break.

In one embodiment, the conductive pin 642 is not secured to the piston housing 514 so that a trigger-pin-breaking pressure differential, $P_{trigger}$, generating a force $F_{trigger}$, needs to be only sufficient to break the trigger pin 640. In that case, T is the tensile breaking strength of the trigger pin 640. In an embodiment in which both the conductive pin 642 and the trigger pin 640 are present, a two-pin-breaking pressure differential, $P_{two\text{-}pin}$, generating a force $F_{two\text{-}pin}$, needs to be sufficient to break both pins.

In one embodiment, the combined tensile breaking strength of the trigger pin 640 and the conductive pin 642 is between 400 and 600 pounds per square inch. In one embodiment, the combined tensile breaking strength of the trigger pin 640 and the conductive pin 642 is between 300 and 800 pounds per square inch. In one embodiment, the combined tensile breaking strength of the trigger pin 640 and the conductive pin 642 is between 200 and 1000 pounds per square inch.

In one embodiment, the trigger pin is non-conductive. In one embodiment, the trigger pin 640 is made of plastic, such as PEEK. In one embodiment, the trigger pin 640 is made of glass. In one embodiment, the trigger pin 640 is made of a ceramic material. In one embodiment, the trigger pin 640 is conductive. In one embodiment, the trigger pin 640 is a thin gauge wire (e.g., AWG 28 or higher) made of metal such as copper or a copper alloy. If the trigger pin 640 is conductive, in one embodiment the trigger pin 640 is installed so that it does not touch or make electrical contact with housing 502.

In one embodiment, the conductive pin 642 is a thin gauge wire (i.e., AWG 28 or higher) made of metal such as copper or a copper alloy.

In one embodiment, the cross-section of the piston 526 is a disk measuring 0.5 inches in diameter, in which case its cross-sectional area is 0.196 inches. If the differential pressure across the piston is 1000 psi, the force F exerted on pins 640 and 642 would be 196 pounds. If the pins are made to break at a tensile force of 100 pounds, a differential pressure of approximately 510 psi (producing a force F of approximately 100 pounds) would be sufficient to break them. Such pressures are common in oil wells deeper than approximately 1500 feet. In one embodiment, for shallower wells in which the pressure is less, the pins are designed to break at lower forces. Similarly, in one embodiment, for deeper wells in which the pressure is greater, the pins may be designed to break at higher forces.

Figure 10:
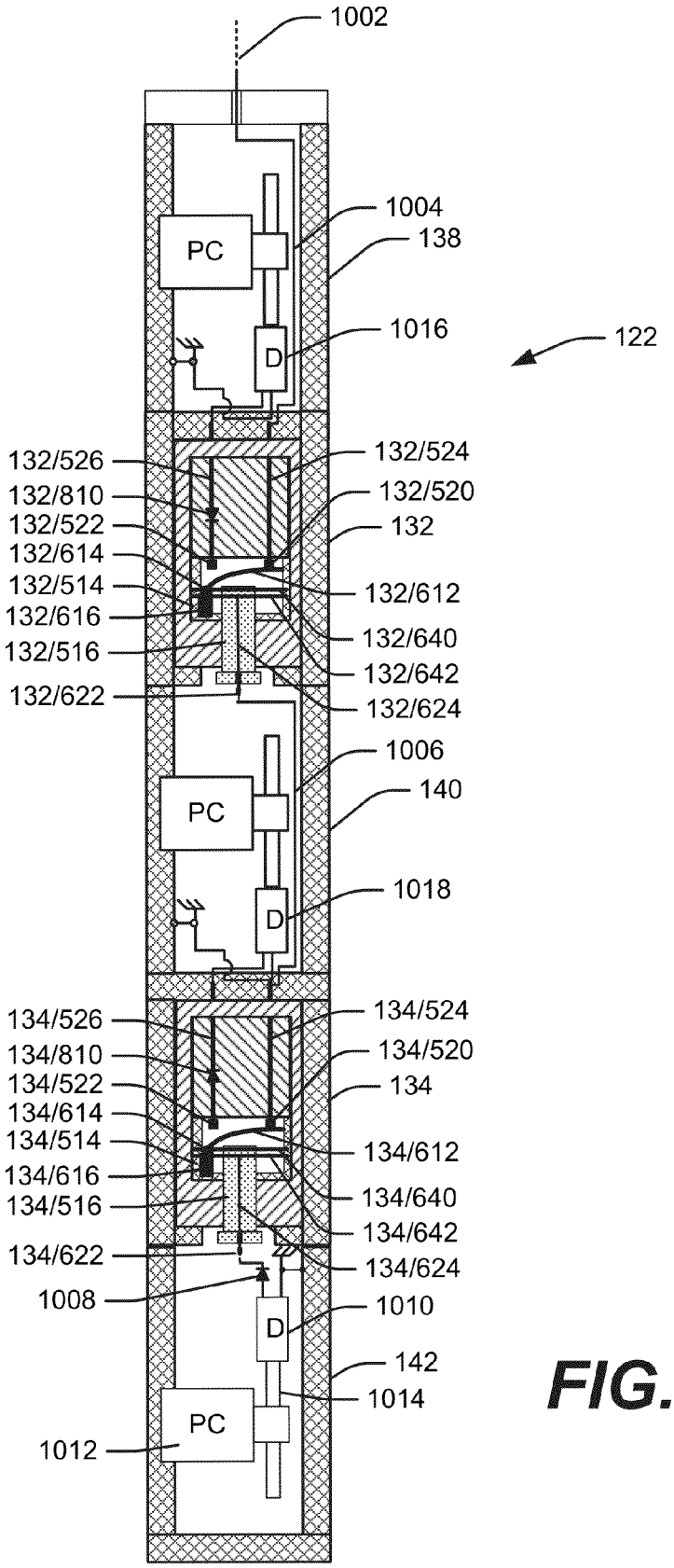
FIGS. 10, 11, and 12 are schematics of a perforation apparatus.
Figure 11:
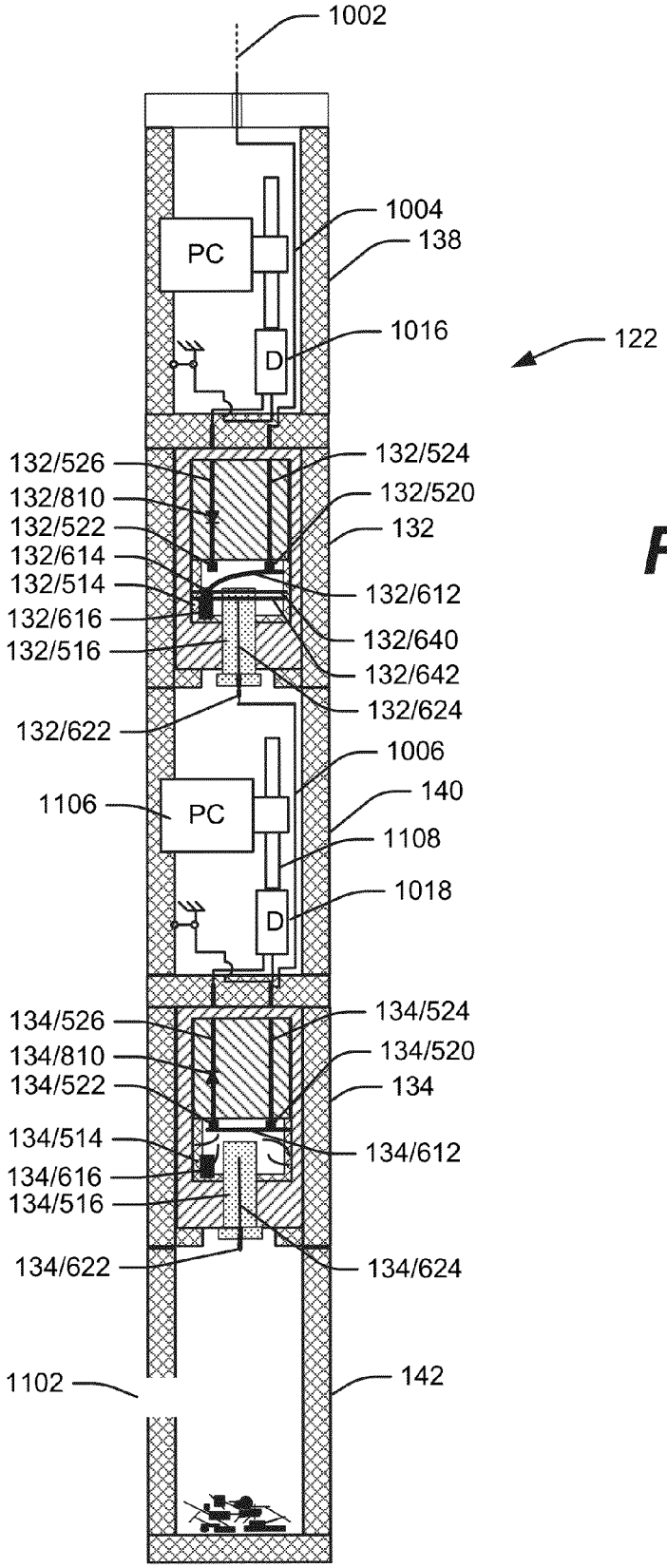
Figure 12:
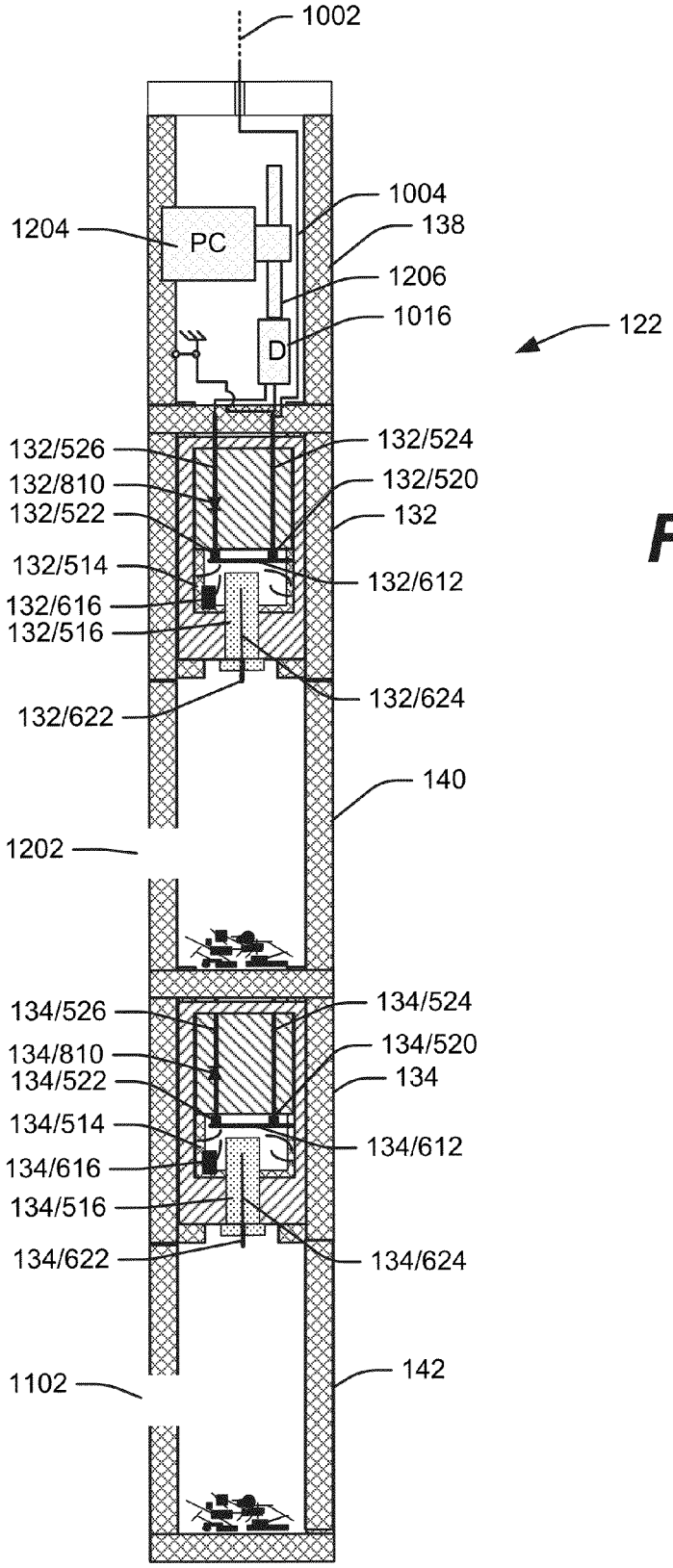

FIGS. 10, 11, and 12 are schematic diagrams of a portion of perforation apparatus 122. Only perforating guns 142, 138, and 140 and select fire subs 134 and 132 are illustrated. It will be understood that the perforation apparatus 122 can include any number of perforating guns and any number of select fire subs by repeating the arrangement shown in FIG. 10. Select fire sub 134 provides the switching for perforating gun 140 and select fire sub 132 provides the switching for perforating gun 138. In one embodiment, select fire subs 134 and 132 have the elements illustrated above in FIGS. 5-9. In the discussion of FIGS. 10 and 11 to follow those elements will be referred to by the select fire sub reference number (i.e., 132 or 134) followed by the element number. For example, the first contact (element 520 in FIGS. 5, 7, 8, and 9) in select fire sub 132 will be referred to as first contact 132/520. In one embodiment, there is no select fire sub associated with perforating gun 142, which means that the detonator 1010 of perforating gun 142 is electrically coupled to pin 134/622 by way of a conducting wire and a diode 1008. A diode 1008 assures that perforating gun 142 is fired with a selected polarity.

As can be seen in FIG. 10, in one embodiment, a power line 1002 enters at the top of the apparatus. In one embodiment, the power line 1002 is coupled to a power line that flows through other perforating guns, other select fire subs, a CCL, a gamma ray correlator, and other equipment higher (i.e. closer to the earth's surface 104) than the equipment shown in FIGS. 10, 11, and 12. In one embodiment, the power line 1002 is coupled to a pass-through line 1004 in perforating gun 138 which passes any voltage present on the pass-through line 1004 to the first contact conductor 132/524 of select fire sub 132. In one embodiment, the first contact conductor 132/524 is coupled to the first contact 132/520 which is connected to the spring 132/612. In one embodiment, the spring 132/612 is in its deflected state in which it is under tension. In one embodiment, the securing bead 132/614 at the end of the spring 132/612 is in contact with the bead contact 132/616. In one embodiment, the bead contact 132/616 provides an electrical connection to the tip contact 132/622 through conductive pin 132/642 and pin conductor 132/624.

In one embodiment, the tip contact 132/622 is electrically coupled to a pass-through line 1006 in perforating gun 140 which passes any voltage present on the pass-through line 1006 to the first contact conductor 134/254 of select fire sub 134. In one embodiment, the first contact conductor 134/524 is coupled to the first contact 134/520 which is connected to the spring 134/612. In one embodiment, the spring 134/612 is in its deflected state in which it is under tension. In one embodiment, the securing bead 134/614 at the end of the spring 134/612 is in contact with the bead contact 134/616. In one embodiment, the bead contact 134/616 provides an electrical connection to the tip contact 134/622 through conductive pin 134/642 and pin conductor 134/624.

In one embodiment, the tip contact 134/622 is coupled to the cathode of diode 1008. The anode of diode 1008 is coupled to a detonator 1010, which is coupled to one or more perforating charges 1012 (i.e., such as perforating charges 402, 404, 406, 408, 410, 412, and 414 shown in FIG. 4) through a detonating cord 1014. The other electrical contact of the detonator 1010 is coupled to the housing of perforating gun 142, which serves as a ground.

In one embodiment, with the perforation apparatus 122 configured as shown in FIG. 10, any voltage or power applied to the power line 1002 will be applied to the cathode of diode 1008. In one embodiment, the detonators on the other two perforating guns 138 and 140, i.e. detonators 1016 and 1018, are protected from detonation because the springs 132/612 and 134/612 are in their deflected positions which means there is no connection between the detonators 1016 and 1018 and the power line 1002.

In one embodiment, a negative voltage is applied to power line 1002 and, through the connections described above, to the cathode of diode 1008. The same negative voltage, minus a diode drop across diode 1008, appears at the detonator 1010 causing it to detonate. That detonation causes perforating charge 1012 to explode.

The result of the explosion is shown in FIG. 11. All or most of the components of the perforating gun 142 have been destroyed and a hole 1102 has been blasted in the housing of perforating gun 142 exposing piston 134/516 to fluids from the borehole. Fluids from the borehole (such as formation fluids or drilling mud) enter perforating gun 142 through hole 1102. These fluids exert pressure on piston 134/516 causing it to move into the piston housing 134/514. This movement breaks the conductive pin 134/642 and the trigger pin 134/640. The latter action releases the securing bead 134/614 and allows the spring 134/612 to move to its relaxed position against the second contact 134/522.

In this configuration, the perforating gun 140 is armed to fire. In one embodiment, the string of connections from the power line 1002 is the same as described above until it reaches the spring 134/612. In one embodiment, the spring 134/612 is in its relaxed position and is in electrical contact with the second contact 134/522. In one embodiment, the second contact 134/522 is coupled to the anode of a diode 134/810. In one embodiment, the cathode of the diode is coupled to detonator 1018 in perforating gun 140, which is coupled one or more perforating charges 1106 (i.e., such as perforating charges 402, 404, 406, 408, 410, 412, and 414 shown in FIG. 4) through a detonating cord 1108.

In one embodiment, with the perforation apparatus configured as shown in FIG. 11 any voltage or power applied to the power line 1002 will be applied to the cathode of diode 134/810. In one embodiment, the detonator on perforating gun 138, i.e. detonator 1016, is protected from detonation because the spring 132/612 is in its deflected position which means there is no connection between the detonator 1016 and the power line 1002.

In one embodiment, a positive voltage is applied to power line 1002 and, through the connections described above, to the anode of diode 134/810. In one embodiment, the same positive voltage, minus a diode drop across diode 134/810, appears at the detonator 1018 causing it to detonate. In one embodiment, that detonation causes perforating charge 1106 to explode.

The result of the explosion is shown in FIG. 12. All or most of the components of the perforating gun 140 have been destroyed and a hole 1202 has been blasted in the housing of perforating gun 140 exposing piston 134/516 to fluids from the borehole. Fluids from the borehole (such as formation fluids or drilling mud) enter perforating gun 140 through hole 1202. These fluids exert pressure on piston 132/516 causing it to move into the piston housing 132/514. This movement breaks the conductive pin 132/642 and the trigger pin 132/640. The latter action releases the securing bead 132/614 and allows the spring 132/612 to move to its relaxed position against the second contact 132/522.

In this configuration, the perforating gun 138 is armed to fire. In one embodiment, the string of connections from the power line 1002 is the same as described above until it reaches the spring 132/612. In one embodiment, the spring 132/612 is in its relaxed position and is in electrical contact with the second contact 132/522. In one embodiment, the second contact 132/522 is coupled to the cathode of a diode 132/810. In one embodiment, the anode of the diode 132/810 is coupled to detonator 1016 in perforating gun 138, which is coupled one or more perforating charges 1204 (i.e., such as perforating charges 402, 404, 406, 408, 410, 412, and 414 shown in FIG. 4) through a detonating cord 1206.

In one embodiment, with the perforation apparatus configured as shown in FIG. 12 any voltage or power applied to the power line 1002 will be applied to the cathode of diode 132/810. In one embodiment, a negative voltage is applied to power line 1002 and, through the connections described above, to the cathode of diode 132/810. In one embodiment, the same negative voltage, minus a diode drop across diode 132/810, appears at the detonator 1016 causing it to detonate. In one embodiment, that detonation causes perforating charge 1204 to explode.

In one embodiment, the polarity of the diodes 1008, 134/810, and 132/810 are chosen so that alternating positive and negative voltages on the power line 1002 are required to detonate alternate perforating guns. That is, a negative voltage on the power line 1002 is required to detonate perforating charge 1012 as dictated by diode 1008, a positive voltage on the power line 1002 is required to detonate perforating charge 1106 as dictated by diode 134/810, and a negative voltage on the power line 1002 is required to detonate perforating charge 1204 as dictated by diode 132/810.

Figure 13:
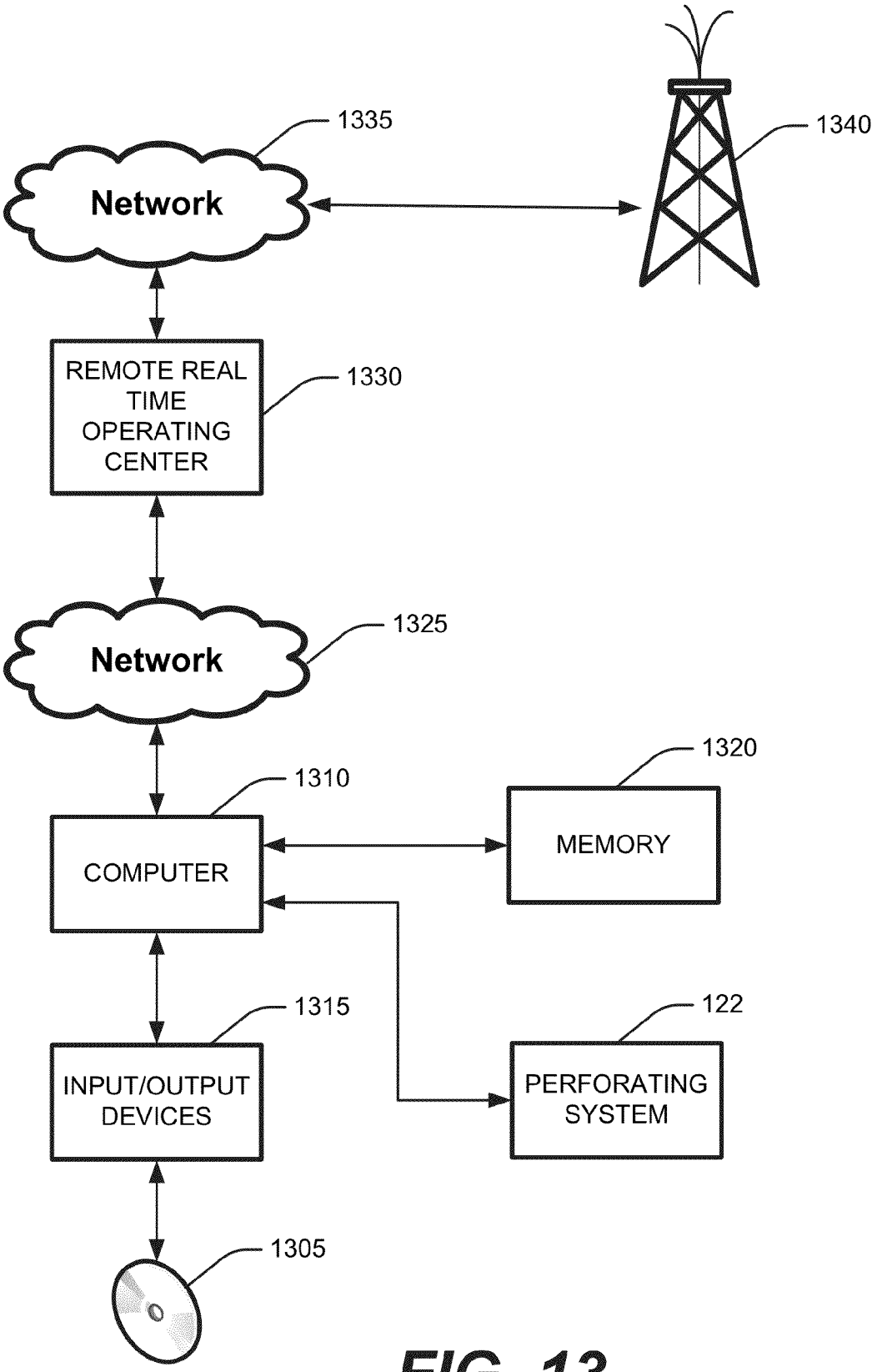
FIG. 13 is a block diagram of an environment for a perforation system.

In one embodiment, the perforating system 122 is controlled by software in the form of a computer program on a computer readable media 1305, such as a CD, a DVD, a portable hard drive or other portable memory, as shown in FIG. 13. In one embodiment, a processor 1310, which may be the same as or included in the firing panel 106 or may be located with the perforation apparatus 122, reads the computer program from the computer readable media 1305 through an input/output device 1315 and stores it in a memory 1320 where it is prepared for execution through compiling and linking, if necessary, and then executed. In one embodiment, the system accepts inputs through an input/output device 1315, such as a keyboard or keypad, and provides outputs through an input/output device 1315, such as a monitor or printer. In one embodiment, the system stores the results of calculations in memory 1320 or modifies such calculations that already exist in memory 1320.

In one embodiment, the results of calculations that reside in memory 1320 are made available through a network 1325 to a remote real time operating center 1330. In one embodiment, the remote real time operating center 1330 makes the results of calculations available through a network 1335 to help in the planning of oil wells 1340 or in the drilling of oil wells 1340.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a piston housing comprising:

a large chamber having an inside diameter, and a small chamber having an inside diameter smaller than the inside diameter of the large chamber, the small chamber being in communication with the large chamber;

a piston having an outside diameter that substantially fits within the small chamber, the piston extending through and moveable within the small chamber, a pinning portion of the piston extending into the large chamber, a contact portion of the piston extending outside the piston housing;

a trigger pin extending through a first hole in the pinning portion of the piston and being secured to a wall of the large chamber on opposite sides of the large chamber;

a conductive pin extending through a second hole in the pinning portion of the piston;

a bead contact coupled to the conductive pin at one of the walls of the large chamber where the conductive pin is secured;

a pin contact coupled to the piston and in electrical contact with the conductive pin;

a tip contact coupled to the contact portion of the piston;

a pin conductor coupled to the pin contact and the tip contact; and a conductive spring, a first end of the spring being embedded in a wall of the large chamber, the spring being held in tension by a second end of the spring being pinned against the bead contact by the trigger pin, wherein the diameter of the piston and a tensile breaking strength of the trigger pin are selected so that the trigger pin is breakable and the tension in the spring is releasable upon the presence of a predetermined pressure difference between a pressure on the contact side of the piston and a pressure on the pinning side of the piston.

2. The apparatus of claim 1 further comprising:

a contact housing having a first end and a second end, the first end being insertable into the large chamber of the piston housing, the contact housing comprising:

a first contact mounted on the first end of the contact housing and coupled to a first contact conductor that runs through the contact housing and exits at the second end of the contact housing, and a second contact mounted on the first end of the contact housing and coupled to a second contact conductor that runs through the contact housing and exits at the second end of the contact housing;

wherein the contact housing is positionable at a position within the large chamber such that:

the first contact is in contact with the spring;

the second contact is separated from the spring but is connectable to the spring upon release of the tension in the spring.

3. The apparatus of claim 2 wherein:

the contact housing comprises a contact housing shoulder where the contact housing narrows to a contract housing shelf, the contract housing shelf having an outside diameter that fits within the large chamber of the piston housing;

the remainder of the contact housing away from the contact housing shelf has an outside diameter that does not fit within the large chamber of the piston housing; and the contact housing shoulder being dimensioned to allow the contact housing to be inserted into the large chamber of the piston housing until it reaches the position.

4. The apparatus of claim 1 wherein:

the conductive pin is secured to a wall of the large chamber on opposite sides of the large chamber.

5. The apparatus of claim 4 wherein:

the diameter of the piston and a combined tensile breaking strength of the trigger pin and the conductive pin are selected so that the trigger pin and the conductive pin are breakable and the tension in the spring is releasable upon the presence of a predetermined pressure difference between a pressure on the contact side of the piston and a pressure on the pinning side of the piston.

6. The apparatus of claim 1 wherein:

the bead contact is pinned to one of the walls of the large chamber by the conductive pin.

7. The apparatus of claim 1 further comprising:

a stop that can be threaded onto the pinning end of the piston to limit the motion of the piston into the piston housing.

* * * * *